United States Patent [19]

Trott

[11] 4,243,495

[45] Jan. 6, 1981

[54] CONTINUOUS ELECTROFORMING OF METAL SHEETS WITH LINES OF WEAKNESS FOR BENDING AND/OR BREAK OUT PORTIONS

[76] Inventor: William A. Trott, 350 Waverley St., Winnipeg, Manitoba, Canada, R3M 3L3

[21] Appl. No.: 63,948

[22] Filed: Aug. 6, 1979

[30] Foreign Application Priority Data

Aug. 18, 1978 [AU] Australia ..... PD5569

[51] Int. Cl.[3] ..... C25D 1/04; C25D 1/08; B32B 25/06; B23P 17/00

[52] U.S. Cl. ..... 204/11; 29/413; 204/12; 428/596

[58] Field of Search ..... 204/3, 4, 11, 12, 13; 428/596, 597; 29/163.5 R, 413, 505

[56] References Cited

U.S. PATENT DOCUMENTS

| | | | |
|---|---|---|---|
| 1,282,264 | 10/1918 | Merritt | 204/12 |
| 2,773,816 | 12/1956 | Wesley | 204/12 |

FOREIGN PATENT DOCUMENTS

| | | | |
|---|---|---|---|
| 1537243 | 12/1978 | United Kingdom | 204/12 |
| 442237 | 12/1974 | U.S.S.R. | 204/13 |

*Primary Examiner*—T. M. Tufariello
*Attorney, Agent, or Firm*—Stanley G. Ade

[57] ABSTRACT

A continuous metal foil or sheet of the desired width and thickness is formed by electroforming and is provided with lines of weakness therethrough. The sheets can be cut off into desired lengths and shipped flat. When required, the sheets can be formed either manually or in a guide form to the desired configuration or shape, by bending along the lines of weakness to provide the structure. If desired, break out portions can be removed which are defined by further lines of weakness through the sheets.

7 Claims, 17 Drawing Figures

FIG. 12
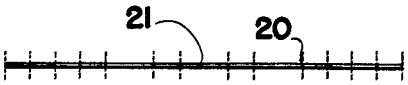
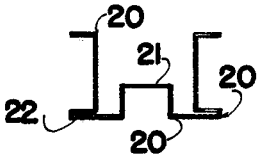
FIG. 13
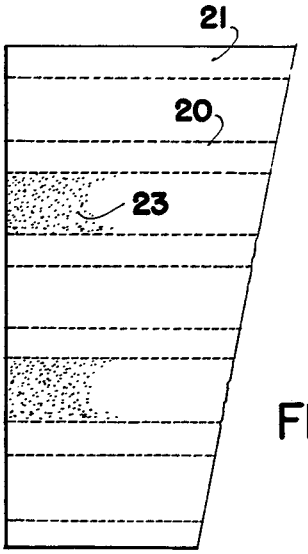
FIG. 14
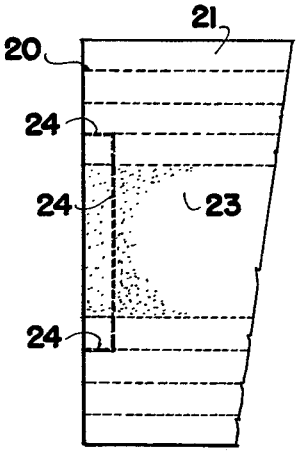
FIG. 16
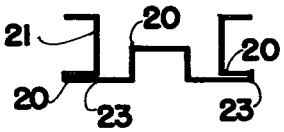
FIG. 15
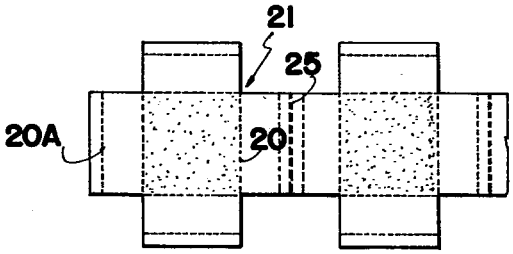
FIG. 17

CONTINUOUS ELECTROFORMING OF METAL SHEETS WITH LINES OF WEAKNESS FOR BENDING AND/OR BREAK OUT PORTIONS

BACKGROUND OF THE INVENTION

This invention relates to the electroforming of foil sheets or panels in a continuous electroforming process.

Heretofore, structural shapes of relatively thin metal are formed by the use of standard cold rolled metal sheets, shears, punch presses, press brakes and traditional finishing methods.

Conventional methods of manufacture to fabricate long linear shapes utilize the roll forming of angular, round or square bends into the sheets when indefinite lengths are required and a high speed production method is necessary.

Another method has been to "brake" shapes to the bends required which limits the length of the pieces to the length of the brake and requires more handling later than the roll forming method.

Both of these are labour intensive and require expensive tooling. Furthermore, the shipping and storage of the finished shape is often awkward and extremely space consuming so that costs of storage and transportation are often excessive.

The present invention overcomes these disadvantages and one aspect of the invention is to provide an electroformed flat sheet of metal having at least one line of weakness formed therethrough during the electroforming thereof, to provide a subsequent bend line for said sheet.

A further aspect of the invention is to provide a method of producing a metal shape having optimum thickness for its structural purpose and having the exact size and contour desired consisting of the steps of electroforming a flat sheet of metal, forming a required number of lines of weakness through the sheet of metal during the electroforming process and then bending the flat sheet of metal to the desired shape along the lines of weakness.

It will be apparent that one of the essential advantages of the present invention is the fact that the sheets or foils can be shipped and stored flat and need only be formed into the shape required, just prior to installation.

The method of manufacture, is, in principle, the least expensive method (a) to create metal shapes of the optimum thickness for its structural purposes; (b) to produce holes, cutouts, contours and the exact size of metal pieces required as part of the process of manufacture and requiring no further processing. There is no scrap (c) to provide low energy shearing, folding, bending or tab hole lines in continuous length production of flat sheet; (d) to produce perforations or random holes of variable size to break up and diffuse sound if desired; (e) to provide organic or inorganic finishes as part of the production process if desired and (f) to manufacture a variety of metals and alloys as might in the future be required.

The advantages in the use of such a new material and method are:

(a) reduction of raw material costs as scrap metal can be used;

(b) reduction in labor costs as handling is drastically reduced;

(c) finishing costs as they are included in the process;

(d) reducing inventory space as all finished production are in the flat;

(e) offer cartoning cost reduction on large projects where, on site, field assembly might be less expensive than factory assembly, cartoning and finished goods freight costs.

As plant costs, labor rates and tooling costs have been increasing steadily, another method to offset these inflationary costs has advantages if it is relatively automatic, can have shape sizes changed without costly tooling and can be shipped in the flat to the most convenient point of use and then formed into its final bent shape with a minimum expenditure of energy such as by bending quickly and easily in the hand or by having it take bent shapes by going through a guide to shape it if the final shape lines have been previously set into the material.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

FIG. 12 is a view similar to FIG. 7 but showing schematically, a plurality of brake lines formed by lines of weakness.

FIG. 13 is an end view of one example of a shape which may be formed from the shape illustrated in FIG. 12.

FIG. 14 is a view somewhat similar to FIG. 5 but showing an alternative location of the lines of weakness and showing how other random perforations may be formed during the electroforming process for such purposes as sound control and the like.

FIG. 15 is an end view of one shape which may be formed from the electroformed sheet illustrated in FIG. 14.

FIG. 16 is a fragmentary plan view of an electroformed sheet showing lines of weakness formed therein, together with lines of weakness which may be used to break out a section of a sheet during the shape forming process.

FIG. 17 is a further fragmentary plan view of an electroformed sheet showing perforated lines of weakness for bending purposes, break out purposes and break off purposes.

In the drawings like characters of reference indicate corresponding parts in the different figures.

DETAILED DESCRIPTION

Proceeding therefore to describe the invention in detail, it will be appreciated that the arrangement of a pattern of easy forming of bend lines may be provided by stopping-off dots, squares, oblongs and other shapes along bend lines during the electroforming process, in the desired locations so that a desired weakness at or along these lines is created whereby bending can be achieved with less energy to make such full or part bends that would be required without such weakness of material being provided.

By varying the amount of material removed in forming the lines of weakness, the amount of weakness to be built into the electroformed sheets or foils may be varied for:

(a) Bending ease required such as by hand or by a guide (b) Thickness of the electroformed material (c) Brittleness of the electroformed material (d) Kind of bend required—angle and/or roundness, squareness, etc.

(e) Spring back of material (f) Rigidity of finally formed shape.

Various stop-off designs may be used and although the designs shown are rectangular-oblongs formed through the metal sheet during the electroforming thereof, other shapes may be used such as square or circular configurations or oblongs with rounded ends.

Figure 1:
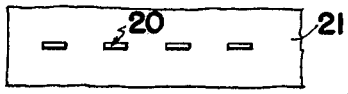
FIG. 1 is a fragmentary plan view of a portion of a sheet showing a line of bend with approximately 50% of the material removed.

In FIG. 1, the line of weakness generally identified by reference character 20, is formed through a sheet or foil 21 in a straight line although it will be appreciated that the line may be curved or angulated as desired. In FIG. 1, the amount of material removed is approximately 50% along the line of weakness.

Figure 2:
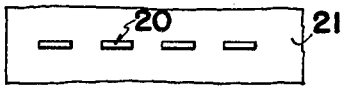
FIG. 2 is a view similar to FIG. 1 but showing approximately 62½% of the material removed.
Figure 3:
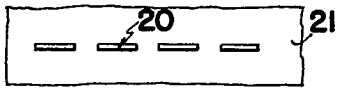
FIG. 3 is a view similar to FIGS. 1 and 2 but showing approximately 75% of the material removed.
Figure 4:
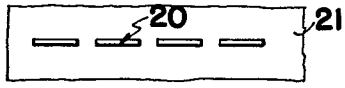
FIG. 4 is view similar to FIG. 1 but showing approximately 87½% of the material removed.

FIGS. 2, 3 and 4 show similar views to that shown in FIG. 1 but with the different amounts of material removed thus changing the aspect of the line of weakness and hence the ease of bending when forming the final shape. In FIG. 2, approximately 62½% of the material is removed, in FIG. 3 approximately 75% of the material and in FIG. 4 approximately 87½% of the material can be removed.

Figure 5:
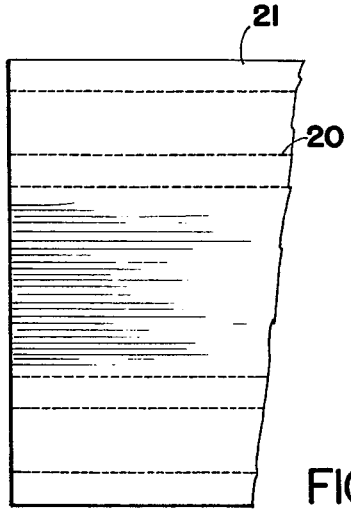
FIG. 5 is a fragmentary plan view of an electroformed sheet showing various lines of weakness formed during the electroforming process.
Figure 6:
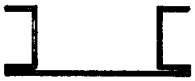
FIG. 6 is an end view of one shape which may be formed from the sheet illustrated in FIG. 5.
Figure 8:
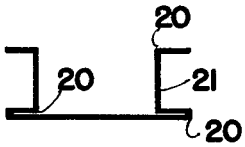
FIG. 8 is an end view of the sheet showing FIG. 7 formed into one possible shape.
Figure 9:
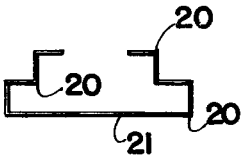
FIG. 9 is an end view showing an alternative shape.
Figure 10:
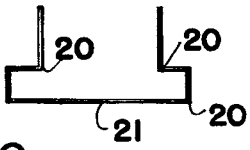
FIG. 10 is an end view showing a still further shape.

In FIG. 5, a sheet 21 is illustrated having a plurality of parallel lines of weakness 20 formed through the sheets during the electroforming process by stop-off methods. When it is desired to form the shape illustrated in FIG. 6, the sheet is angulated along the lines of weakness 20 either manually or by passing same through a guide form so that the configuration shown in FIG. 6, for example, may be formed thus giving the necessary rigidity and finished size to the shape.

Figure 7:
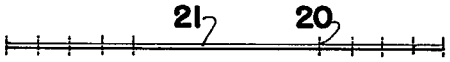
FIG. 7 is a schematic end elevation of an electroformed sheet showing schematically the location of various brake lines defined by lines of weakness.
Figure 11:
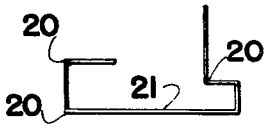
FIG. 11 is an end view showing still another shape.

FIG. 7 shows the end view of a flat electroformed sheet, illustrated schematically with reference character 20 indicating lines of weakness acting as brake lines formed during the electroforming process and FIGS. 8, 9, 10 and 11 show various shapes which can be formed from the single electroformed sheet illustrated in FIG. 7. Once again these shapes may be formed manually or through a guide form depending upon the length and thickness of the metal forming the sheet.

FIG. 12 shows a schematic view similar to FIG. 7 but with the lines of weakness formed in different locations so that a shape similar to that illustrated in FIG. 13 may be formed as an example.

In several of the examples illustrated, reference should be made to the counterangulated portion 22 in which one portion is angulated in juxtaposition to another thus giving additional thickness to this point which gives desired rigidity and strength to the finished structure under certain circumstances.

FIG. 14 shows a schematic plan view of an electroformed sheet 21 having a plurality of lines of weakness 20 formed longitudinally therealong with certain areas defined by reference character 23, containing random perforations. These may be used for sound control, or other purposes depending upon the use to which the finished section is placed and FIG. 15 shows one example of the configuration which can be formed from the sheet shown in FIG. 14 with the perforated sections 23 being clearly illustrated in spaced apart parallel relationship to one another.

FIG. 16 shows a view of a portion of a sheet 21 electroformed with the spaced and parallel longitudinally extending lines of weakness 20 and a random perforated area 23 centrally thereof. Further lines of weakness 24 are provided and this permits the portion defined by lines 24 to be broken out and removed prior to the folding of the sheet to the desired shape.

FIG. 17 shows a yet further example of an electroformed sheet collectively designated 21 with lines of weakness 20 formed in both directions and break away lines 25 formed transversely at intervals along the electroformed sheet. In this particular example, the cruciform sections are broken off along the lines 25 and may then be formed into an open sided cube by bending along the lines of weakness 20 with out turned flanges being formed by bending along the lines of weakness 20A. These may be dropped into any form of framework and are merely given as an example of the flexibility of the product and method forming part of this invention.

Summarizing, continuous sheets of metal may be formed by an electroforming process and provided with lines of weakness at desired locations by forming stop-offs in the electroforming process. These lines of weakness permit the sheets to be shipped and stored in a rolled or flat condition and then formed to the desired shape when required. Furthermore break out portions are usually provided by additional lines of weakness and the strength of the lines of weakness may be varied by varying the degree of material removed during the electroforming of the sheets.

The electroforming process is suited to the formation of a continuous sheet or foil which may be cut or broken off at predetermined intervals to provide flat sheets for subsequent bending along the lines of weakness or may be rolled for ease of shipping and storage for subsequent breaking off or cutting off when desired.

Furthermore it will be appreciated that a variety of metals can be used which are readily pre-finished if desired and random perforations can readily be provided during the electroforming process and desired locations within the sheet.

Finally the desired rigidity is easily provided by counterfolding adjacent portions of the sheet along the preformed lines of weakness provided for this purpose.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. An electroformed flat sheet of metal having at least one line of weakness formed therethrough during the electroforming thereof, said line of weakness comprising a plurality of apertures formed through said sheet and constituting the removal of between 50% and 90% of the metal along the line of weakness, said apertures being in the same plane as the sheet and flush with both surfaces thereof.

2. The invention according to claim 1 in which the apertures forming the line of weakness are rectangular when viewed in plan.

3. The invention according to claim 1 in which the apertures forming the line of weakness are circular when viewed in plan.

4. The invention according to claims 1, 2 or 3 which include at least one line of weakness constituting a bend line and at least one line of weakness constituting a break out line.

5. A method of producing a metal shape having optimum thickness for its structural purpose and having the exact size and contour desired consisting of the steps of electroforming a flat sheet of metal, forming a required number of lines of weakness through the sheet of metal during the electroforming process by removing from between 50% and 90% of the material along the line of weakness thereby defining a plurality of apertures in the same place as the sheet of metal and flush with the upper and lower surfaces thereof and then bending the flat sheet of metal to the desired shape along the lines of weakness.

6. The method according to claim 5 which includes the additional step of forming additional lines of weakness through the metal sheet during the electroforming thereof to define break out portions and then breaking out said portions along said additional lines of weakness when forming said metal shape from said flat sheet.

7. The method according to claims 5 or 6 in which the flat sheet of metal is formed continuously and stored in a roll.

* * * * *